United States Patent [19]

Logan et al.

[11] Patent Number: 5,043,739

[45] Date of Patent: Aug. 27, 1991

[54] HIGH FREQUENCY RECTENNA

[75] Inventors: B. Grant Logan, Danville; William J. Orvis, Livermore, both of Calif.

[73] Assignee: The United States of America as represented by the United States Department of Energy, Washington, D.C.

[21] Appl. No.: 472,548

[22] Filed: Jan. 30, 1990

[51] Int. Cl.[5] ..... H01Q 1/26

[52] U.S. Cl. ..... 343/701; 343/893

[58] Field of Search ..... 343/701, 753, 700 MS, 343/846, 893

[56] References Cited

U.S. PATENT DOCUMENTS

| | | | |
|---|---|---|---|
| 2,855,543 | 4/1953 | White | 315/34 |
| 3,114,517 | 12/1963 | Brown | 244/1 |
| 3,434,678 | 5/1965 | Brown | 244/1 |
| 3,535,543 | 10/1970 | Dailey | 307/149 |
| 3,544,998 | 12/1970 | Vandenplas et al. | 343/701 |
| 3,711,848 | 1/1973 | Martens | 343/701 |
| 3,789,471 | 2/1974 | Spindt et al. | 357/6 |
| 3,852,755 | 12/1974 | Works et al. | 343/701 |
| 4,008,477 | 2/1977 | Babij et al. | 343/701 |
| 4,079,268 | 3/1978 | Fletcher et al. | 343/700 MS |
| 4,155,155 | 5/1979 | Bourdon et al. | 29/590 |
| 4,516,037 | 5/1985 | Shackle | 307/252 A |
| 4,587,545 | 5/1986 | Berthold et al. | 357/38 |
| 4,721,885 | 1/1988 | Brodie | 313/576 |
| 4,853,703 | 8/1989 | Murakami et al. | 343/701 |
| 4,853,705 | 8/1989 | Landt | 343/701 |
| 4,855,636 | 8/1989 | Busta et al. | 313/306 |
| 4,955,562 | 9/1990 | Martin et al. | 244/62 |

OTHER PUBLICATIONS

"The History of Power Transmission by Radio Waves", by William C. Brown, IEEE Transactions on Microwave Theory and Techniques, vol. MIT-32, No. 9, 9/1984.

"Rectenna Technology Program: Ultra Light 2.45 GHz Rectenna and 20 GHz Rectenna", by William C. Brown, Prepared for National Aeronautics and Space Administration, NASA Lewis Research Center, Contract NAS3-22764.

"Initiative for the 21st Century: Advanced Space Power and Propulsion Based on Lasers", by B. G. Logan, Lawrence Livermore National Laboratory Report No. UCRL-98520.

*Primary Examiner*—Michael C. Wimer
*Assistant Examiner*—Hoanganh Le
*Attorney, Agent, or Firm*—H. P. Sartorio; L. E. Carnahan; William R. Moser

[57] ABSTRACT

The invention provides an inexpensive array of rectifying antennas which employ field emission diodes for rectifying electromagnetic waves of microwave frequencies and higher frequencies.

15 Claims, 5 Drawing Sheets

HIGH FREQUENCY RECTENNA

BACKGROUND OF THE INVENTION

The United States Government has rights in this invention pursuant to Contract No. W-7405-ENG-48 between the U.S. Department of Energy and the University of California, for the operation of Lawrence Livermore National Laboratory.

A rectenna, or rectifying antenna, comprises an antenna and a diode rectifier. In operation, the antenna gathers electromagnetic energy at a frequency consistent with its size and shape, and the diode rectifies that energy into D.C. current.

Presently, rectennas utilize a semiconductor diode or large vacuum diode to rectify electromagnetic waves, with frequencies ranging up to the radio frequency spectrum, to direct current. Rectennas utilizing a semiconductor diode have an upper frequency limit and an upper intensity limit due to the inherent limitations of semiconductor diodes. These limitations include the device capacitance and the fragility of high speed semiconductor devices. Rectennas using large vacuum tubes also have upper frequency limits and are expensive to build. Large arrays of rectennas using conventional vacuum tubes would be prohibitively expensive to build, and could not be produced in a compact form.

William C. Brown in "The History of Power Transmission of the Rectenna," in the IEEE Transactions on Microwave Theory and Techniques, Vol. MTT-32, No. 9, September 1984, describes the development of rectennas for rectifying electromagnetic signals with a frequency of 2.45 Giga Hertz (GHz). The article describes research into an apparatus that would be able to allow power to be sent from the earth to a device above the earth or to allow power to be sent from above the earth to the earth via a 2.45 GHz radio signal. The author states that the best diodes that he found for the rectennas are either silicon or gallium arsenide (GaAs) Schottky-barrier diodes.

William C. Brown in "Rectenna Technology Program: Ultra Light 2.45 GHz Rectenna and 20 GHz Rectenna," published by NASA as PT-6902, CR 179558, Mar. 11, 1987 describes the development of a 2.45 GHz rectenna and proposes a 20 GHz rectenna. The article first describes the development of a 2.45 GHz rectenna. The GaAs Schottky barrier diodes for the 2.45 GHz rectenna have specifications including a zero bias capacitance of 3 pf and a reverse breakdown voltage of 60–70 volts. These specifications and other qualities of the Schottky barrier diodes limit the efficiency and the maximum power capabilities of these rectennas. The article goes on to propose a 20 GHz and higher frequency rectenna. The article states that the losses in the diode will be considerably greater at these higher frequencies and the losses in the scaled circuit structure will become greater by the square root of the frequency scaling factor because of skin losses. Because semiconductor diodes break down at high temperatures, semiconductor diodes must be cooled. In the design proposed in the article for a 20 GHz rectenna, reasonable cooling is provided if the rectenna is limited to a DC power output of 0.4 watts per diode element with an output voltage of 8.9 volts and a reverse voltage breakdown of 20 volts. At higher intensities, the resistance in the rectenna will create more heat elevating the semiconductor temperature and causing the semiconductor to breakdown. These parameters help illustrate the inefficiency and fragileness of semiconductor diodes in a rectenna.

Because of the inherent limitations of semiconductor rectennas and large vacuum tube rectennas, there is a need for rectennas that can rectify high frequency and high intensity electromagnetic waves.

The invention provides an array of rectennas, which are able to rectify high frequency microwave or high frequency and high intensity electromagnetic radiation. These arrays may be useful in transportation of power through electromagnetic waves and conversion of intense high frequency electromagnetic radiation into direct current. Applications of the invention include sending power to satellites or high altitude devices from the earth by electromagnetic waves, transmission of power from satellites which collect solar power and convert it to electromagnetic waves which are transmitted to the earth, and direct conversion of microwaves generated by fusion reactions into a direct current.

SUMMARY OF THE INVENTION

It is an object of the invention to provide a rectenna which can rectify electromagnetic radiation with wavelengths equal to or shorter than the wavelengths of microwaves.

It is another object of the invention to provide a rectenna which can rectify electromagnetic waves at high intensities.

It is another object of the invention to provide a rectenna which can rectify electromagnetic radiation with wavelengths equal to or shorter than the wavelengths of microwaves and with high intensities, and with an efficiency greater than 40%.

It is another object of the invention to provide a rectenna which is resilient to high energy radiation and high temperatures.

It is another object of the invention to provide an array of rectennas which can be manufactured in large numbers at a low cost.

It is another object of the invention to provide a compact array of rectennas.

Additional objectives, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

The invention comprises an antenna, comprising a first half and a second half, and at least one field emission vacuum diode electrically connected between the first half and the second half of the antenna to provide a rectenna. The diode is made an integral part of the antenna so that arrays of rectennas can be used for rectifying electromagnetic radiation with a frequency higher than or equal to microwave frequencies. If the diode was not integral to the antenna, and if an array of antennas was connected together, then phase differences from one side of the array to the other would cause the combined outputs to cancel, significantly decreasing the output. By making the diode an integral part of the antenna, the current is rectified at the source, and phase differences will have little effect on the combined currents.

BRIEF DESCRIPTION OF THE DRAWINGS

The accompanying drawings, which are incorporated and form a part of the specification, illustrate several embodiments of the invention and, together with the description, serve to explain the principles of the invention.

DESCRIPTIONS OF THE PREFERRED EMBODIMENTS

Figure 1:
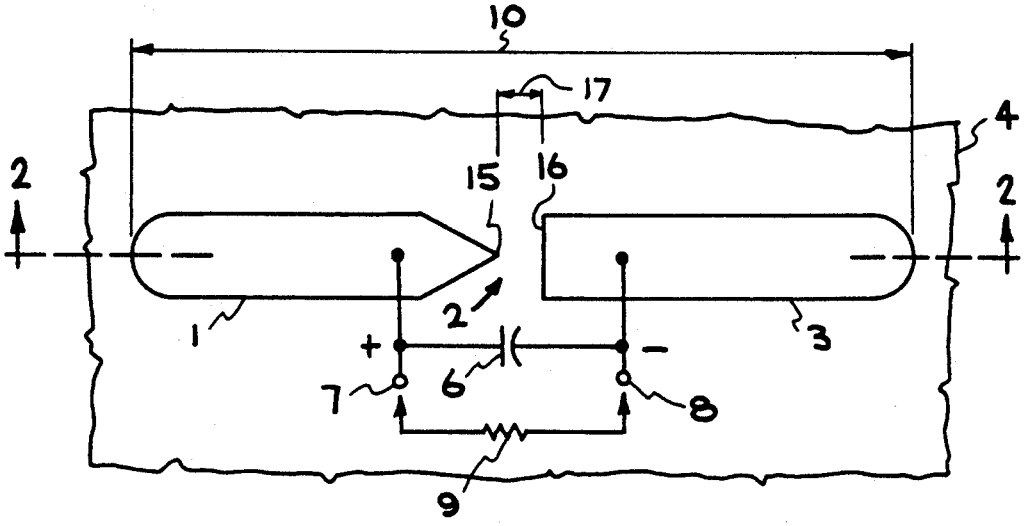
FIG. 1 is a top view of a preferred embodiment of the invention. It illustrates a half wave rectenna using a dipole antenna and a single lateral field emission diode.
Figure 2:
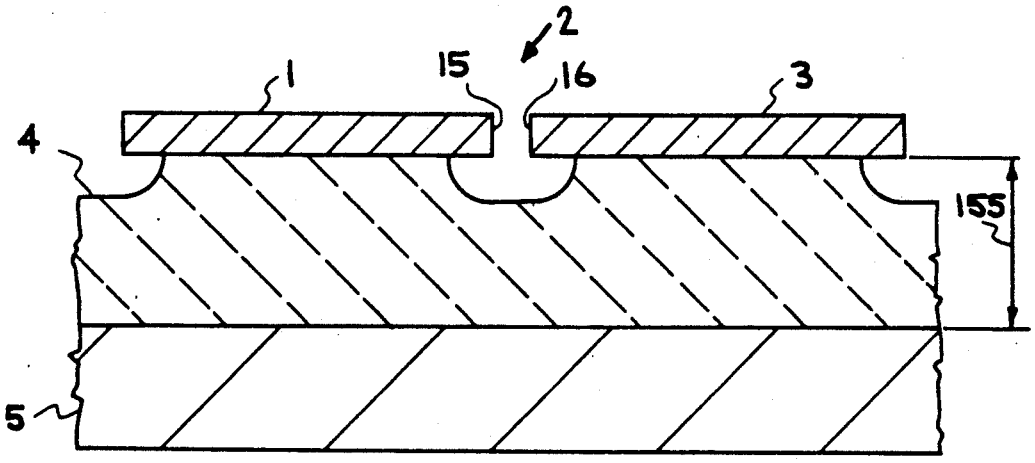
FIG. 2 is a cross-sectional view of a half wave rectenna illustrated in FIG. 1 along lines 2.

FIGS. 1 and 2 show a top and side view of a preferred embodiment of the invention. The invention receives and rectifies an electromagnetic wave with wavelength L. It includes a dipole antenna (1 and 3), coupled with an integral lateral field emission diode 2 at the center, and an external capacitor 6. In the preferred embodiment the total length 10 of the dipole antenna is approximately L/2.

The embodiment may be constructed using conventional semiconductor manufacturing techniques on an insulating substrate 4 attached to a conducting ground plane 5 (FIG. 2). The ground plane makes the antenna directional, with the vertical direction being the preferred direction. The separation 155 between the antenna and the ground plane is preferably approximately L/4 to provide a maximum reflection of electromagnetic radiation which passes through the antenna 1 and 3 to the ground plane. The actual distance would depend on the material used as the insulating substrate.

Using conventional semiconductor techniques, a layer of conductive material (tungsten, or doped polysilicon for example) is deposited on the insulator and then shaped by photolithography and wet or dry etching. The insulator under the layer of conductive material is then etched, undercutting the conductor. This undercutting frees the edge of the conductor to prevent surface leakage currents and surface breakdown along the insulator between the two sides of the antenna.

The method of making a field emission vacuum triode is disclosed in U.S. Pat. No. 4,855,636 by Busta et al, which is incorporated by reference. Using the method described in Busta et al. a field emission diode in a vacuum could be created. By using a differently shaped mask the field emission diode can be integrated into a dipole antenna. Even though Busta discloses the creation of a triode, the field emission diode could be created in a similar manner by either sealing the etching holes described in Busta with an insulating material or by not applying a charge to the gate of the triode. For cases where the mean free path of an electron in a gas at some pressure is comparable to the separation of the anode and cathode, the diode will operate in that gas at that pressure as if it were in a vacuum. In addition, a low pressure or near vacuum can also be established around the field emission diode by sealing the entire rectenna in a near vacuum container.

Electromagnetic radiation of wavelength L is absorbed by the dipole antenna 1 and 3. According to well known principles of antenna design, the electromagnetic radiation will set up an oscillating potential difference between the first half 1, and the second half 3 of the dipole antenna. The potential difference will oscillate with the same frequency as the absorbed electromagnetic radiation. This oscillating potential difference will manifest itself across the lateral field emission diode 2 whose cathode, manifested by cathode tip 15 which is a pointed edge of the first half 1 of the antenna, is integral with the first half 1 of the antenna, and whose anode, manifested by anode surface 16 which is a nonpointed edge of the second half 3 of the antenna, is integral with the second half 3 of the antenna. The pointed edge making the cathode tip 15 is located on a part of the first half 1 of the antenna that is located closest to the second half 3 of the antenna as shown. The nonpointed edge making the anode surface 16 is located on a part of the second half 3 of the antenna that is located closest to the first half 1 of the antenna.

During the positive half cycle of the electromagnetic radiation, the second half 3 of the antenna is positive with respect to the first half 1 of the antenna, and field emission of electrons occurs off of the tip of the cathode 15. The field emitted electrons will be absorbed at the anode surface 16, causing a surplus of electrons in the second half 3 of the antenna. During the negative half cycle, the second half 3 of the antenna is negative with respect to the first half 1 of the antenna. Since the anode surface 16 is flat, it does not emit an appreciable amount of electrons and thus no field emission current flows in the negative half of the cycle. Thus, a voltage is applied to the capacitor 6, and any load 9 attached to terminals 7 and 8. This allows the surplus of electrons in the second half 3 of the antenna to flow through the attached load 9 back to the first half 1 of the antenna. The capacitor 6 smooths the voltage available at the terminals by charging from the antenna during the negative half cycle and discharging through the load 9 during the positive half cycle. This illustrates how the cathode tip 15 forming the cathode is integrally and electrically connected to the first half 1 of the antenna and how the anode is integrally and electrically connected to the second half 3 of the antenna and how a field emission diode 2 comprising the anode 16 and cathode 15 are electrically connected between the first half 1 and the second half 3 of the antenna.

In the preferred embodiment shown in FIG. 1, the rectenna is designed to rectify an electromagnetic wave having a predetermined frequency between 1,000 GHz and 10 GHz. This would require that the separation 17 between the anode and cathode be less than 10 microns, and preferably less than 3 microns.

Figure 3:
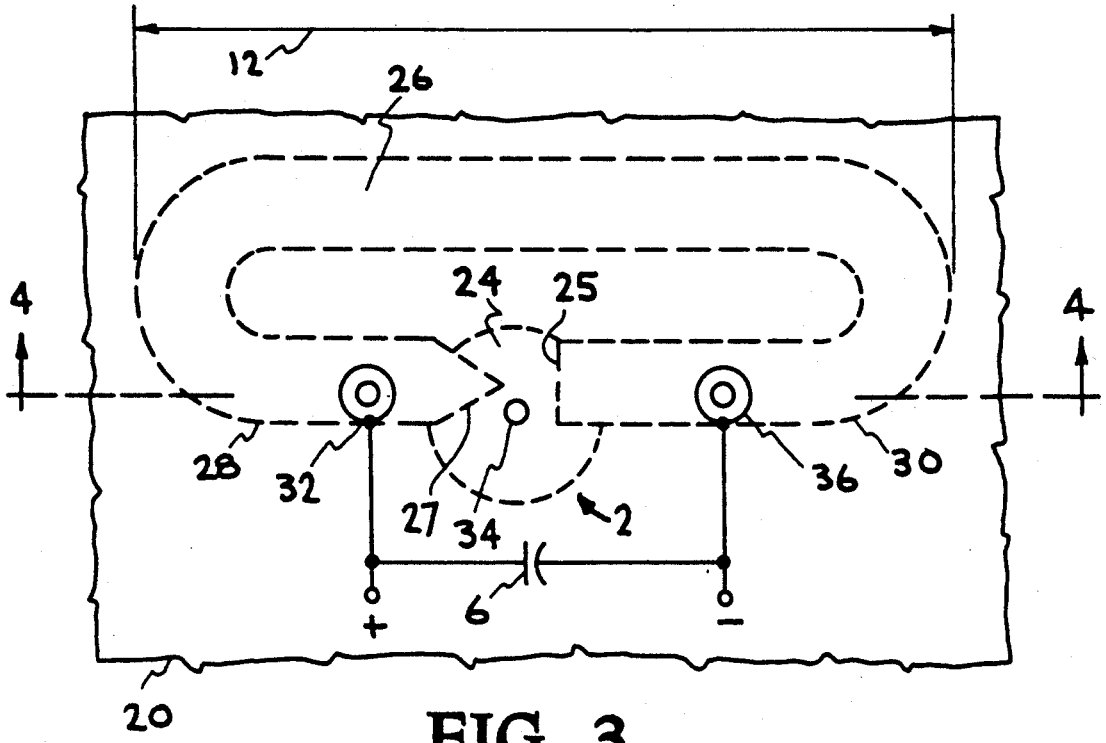
FIG. 3 is a top view of another embodiment, a half wave rectenna using a folded dipole antenna and a single lateral field emission diode.
Figure 4:
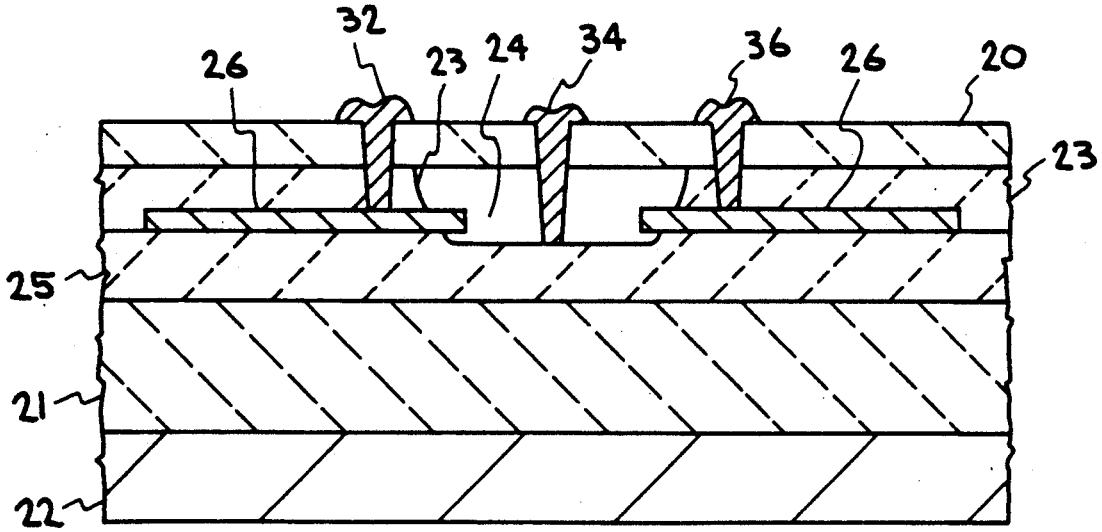
FIG. 4 is a cross-sectional view of a half wave rectenna illustrated in FIG. 3 along lines 4.

The rectenna is not limited to a dipole antenna design, nor to the half wave rectifier described above. FIG. 3 shows a similar structure, but using a folded dipole antenna 26 instead of the simple dipole antenna. The folded dipole antenna 26 typically has a higher impedance than the simple dipole, which may make a better coupling between the antenna and the diode. The folded dipole antenna 26 could be manufactured in the same way as the embodiment shown in FIG. 1, having the same cross-sectional view. For illustrative purposes, the folded dipole antenna shown in FIG. 3 is made using the method described in U.S. Pat. No. 4,855,636 by Busta et al. FIG. 4 is a cross-sectional view of FIG. 3 along lines 4. In this embodiment a silicon wafer 21 is attached to a conducting layer 22. Preferably the silicon wafer 21 has a thickness equal to approximately ¼ the wavelength of the electromagnetic radiation to be rectified. As described in U.S. Pat. No. 4,855,636 approximately 1 micron of thermal silicon dioxide is grown on the silicon wafer 21 forming a first insulating layer 25. A conducting layer is deposited on the first insulating layer 25 to form the folded dipole antenna 26 with a first half 28 and second half 30 of the antenna and an integrated anode 25 and cathode 27. In the preferred embodiment the length 12 of the folded dipole antenna 26 is approximately equal to L/2, where L is the wavelength of the electromagnetic radiation to be rectified. The entire structure is then covered by a layer of undoped, highly resistive polycrystalline silicon 23. The upper surface of the polycrystalline silicon 23 is thermally oxidized to form a top insulating layer 20. Windows are made through the top insulating layer 20 to allow the etching of a chamber 24 and holes for contacts 32 and 36. A metallic layer is then applied over the top insulating layer 20 and then etched back to create contacts 32 and 36 and for creating a window plug 34.

The folded dipole rectenna shown in FIGS. 3 and 4 rectifies electromagnetic waves in the same manner as the dipole rectenna described above. Using the described method of building the folded dipole rectenna, the integrated diode can be made so that the separation between the cathode tip 27 and the anode surface 25 would be in the above described range for rectifying signals with frequencies higher than 10 GHz. At an operating voltage of 500 volts it is estimated that the leakage current due to parasitic current through the undoped polycrystalline silicon layer 23 would be 500 pico Amps. This leakage could be further reduced by replacing the polycrystalline silicon side walls with silicon dioxide side walls. The integration of field emission diodes with an antenna in this embodiment provides a very efficient rectenna that can rectify signals with frequencies equal to or greater than microwaves. In addition, the provided diodes can easily handle 500 volts, wherein the Schottky barrier diodes used in the prior art had a reverse breakdown voltage of 60–70 volts.

Figure 5:
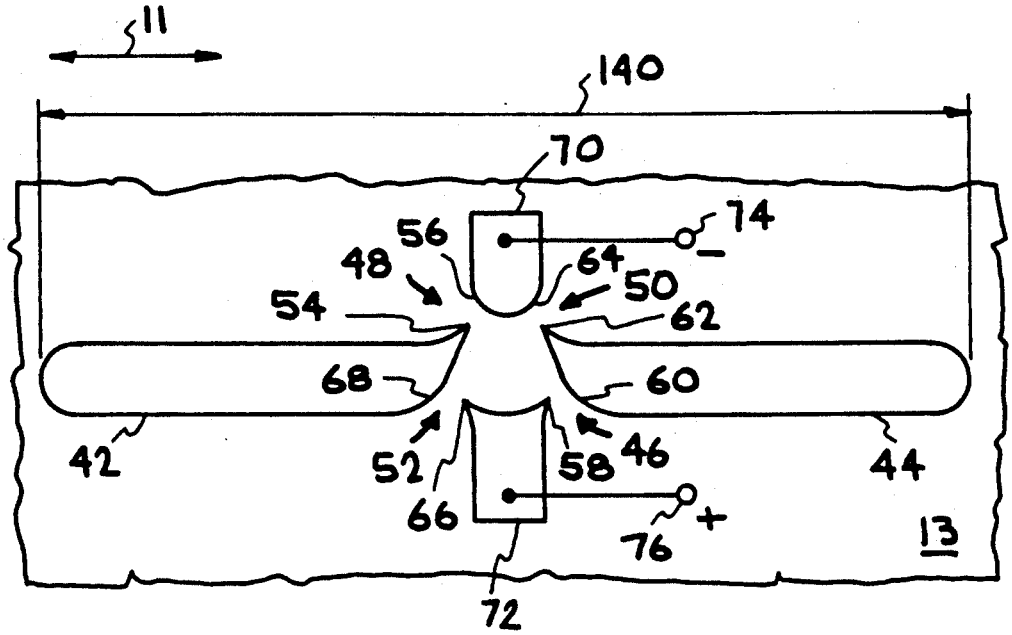
FIG. 5 is a top view of another embodiment, a full wave rectenna using a dipole antenna and a full wave bridge rectifier using four lateral field emission diodes.

FIG. 5 shows a rectenna with a dipole antenna, comprising a first strip of conductive material on a substrate 13 with a length along a first direction 11 less than L/2, where L is the wavelength of the electromagnetic radiation to be rectified, forming a first half 42 of the antenna and a second conductive strip on a substrate 13 with a length along the first direction 11 less than L/2 forming a second half 44 of the antenna, and a full wave bridge rectifier. The second conductive strip 44 is located along the first direction 11 with respect to the first conductive strip 42. The rectifier utilizes four field emission diodes 46, 48, 50 and 52 arranged in a full wave bridge configuration. The configuration illustrated in FIG. 5 is manufactured in the same manner as the embodiment illustrated in FIG. 1. It would also be possible for this embodiment to be manufactured in the same manner as the embodiment illustrated in FIG. 3.

Electromagnetic radiation of wavelength L is absorbed by the dipole antenna 42 and 44. According to well known principles of antenna design, incident electromagnetic radiation will set up an oscillating potential difference between the first half 42, and the second half 44 of the dipole antenna. The potential difference will oscillate at the same frequency as the absorbed electromagnetic radiation. This oscillating potential difference will manifest itself across the lateral field emission diodes.

During the positive half cycle of the electromagnetic radiation, the second half 44 of the antenna is positive with respect to the first half 42 of the antenna, and field emission of electrons occurs off of the tip of a cathode tip 54 of a first diode 48, wherein the cathode tip 54 is an integral part of the first half 42 of the antenna formed by a pointed edge of the first strip of conductive material which forms the first half 42 of the antenna. The field emitted electrons will be absorbed at the anode surface 56 of the first diode 48, which is formed by a nonpointed edge of a third strip of conductive material forming an anode terminal 70, causing a surplus of electrons in the anode terminal 70. Also during the positive half cycle of the electromagnetic radiation, field emission of electrons occurs off of the tip of cathode 58 of a second diode 46, wherein the cathode tip 58 is formed by a pointed edge of a fourth strip of conductive material on the substrate 13, wherein the fourth strip of conductive material forms a cathode terminal 72. The field emitted electrons will be absorbed at the anode surface 60 of the second diode 46, wherein the anode surface 60 is an integral part of the second half 44 of the antenna, causing a surplus of electrons in the second half 44 of the antenna. During the negative half cycle, the second half 44 of the antenna is negative with respect to the first half 42 of the antenna, and field emission of electrons occurs off of the tip of the cathode tip 62 of a third diode 50, wherein the cathode tip 62 is an integral part of the second half 44 of the antenna. The field emitted electrons will be absorbed at the anode surface 64 of the second diode 50, which is part of the anode terminal 70, causing a surplus of electrons in the anode terminal 70. Also during the negative half cycle of the electromagnetic radiation, field emission of 5 electrons occurs off of the tip of cathode 66 of a fourth diode 52, wherein the cathode tip 66 is part of the cathode terminal 72. The field emitted electrons will be absorbed at the anode surface 68 of the fourth diode 52, wherein the anode surface 68 is an integral part of the first half 42 of the antenna, causing a surplus of electrons in the first half 42 of the antenna.

Thus, during the full wavelength electrons flow from the cathode terminal 72 to either the first 42 or second 44 half of the antenna and then to the anode terminal 70. The surplus of electrons gathered at the anode terminal 70 can flow through the negative load terminal 74 electrically connected to the anode terminal and then through a load to a positive load terminal 76 electrically connected to the cathode terminal 72. The anode terminal 70 acts as an anode for both the first part 42 of the antenna and the second part 44 of the antenna, and the cathode terminal 72 acts as a cathode for both the first part 42 of the antenna and the second part 44 of the antenna. Although a capacitor is not needed, it may be used to smooth the current flow between terminals 74, 76.

In the preferred embodiment of the invention, the total length 140 of the first half 42 and the second half 44 of the antenna along the first direction 11 is approximately equal to L/2. As shown in FIG. 5, the four rectifying field emission diodes are electrically connected between the first half 42 and the second half 44 of the antenna making two parallel sets of two diodes in series.

Figure 6:
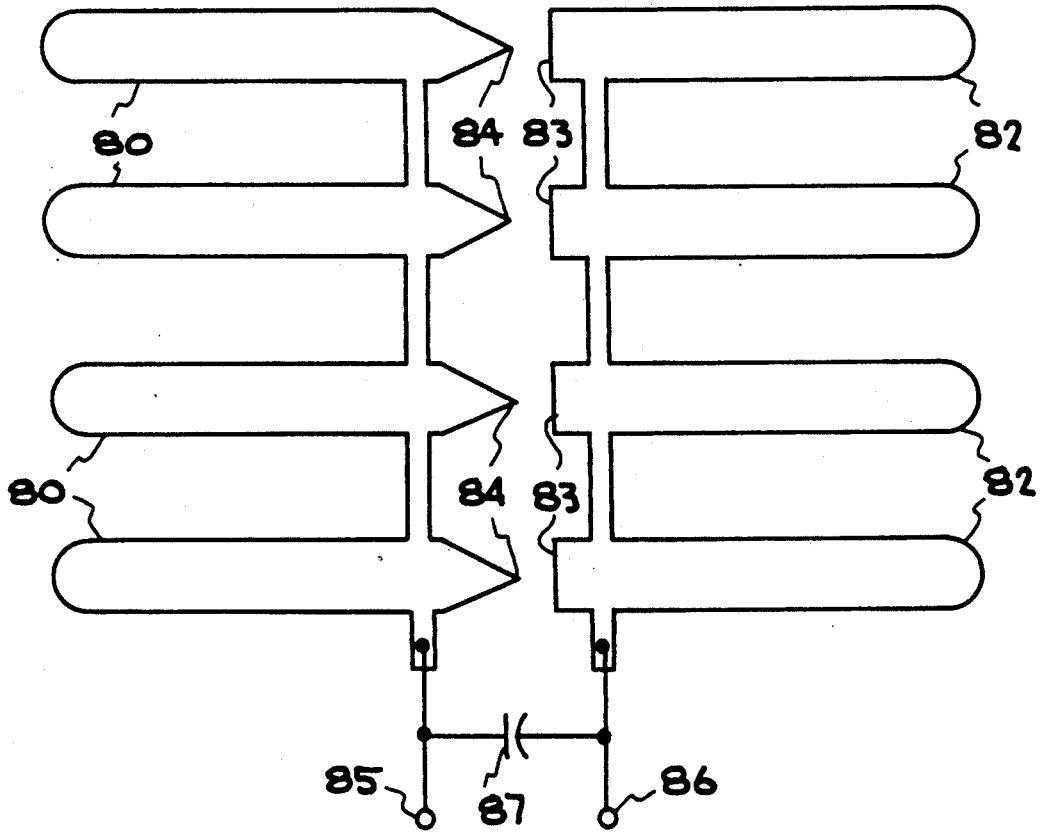
FIG. 6 is a top view of an array of half wave rectennas in parallel.
Figure 7:
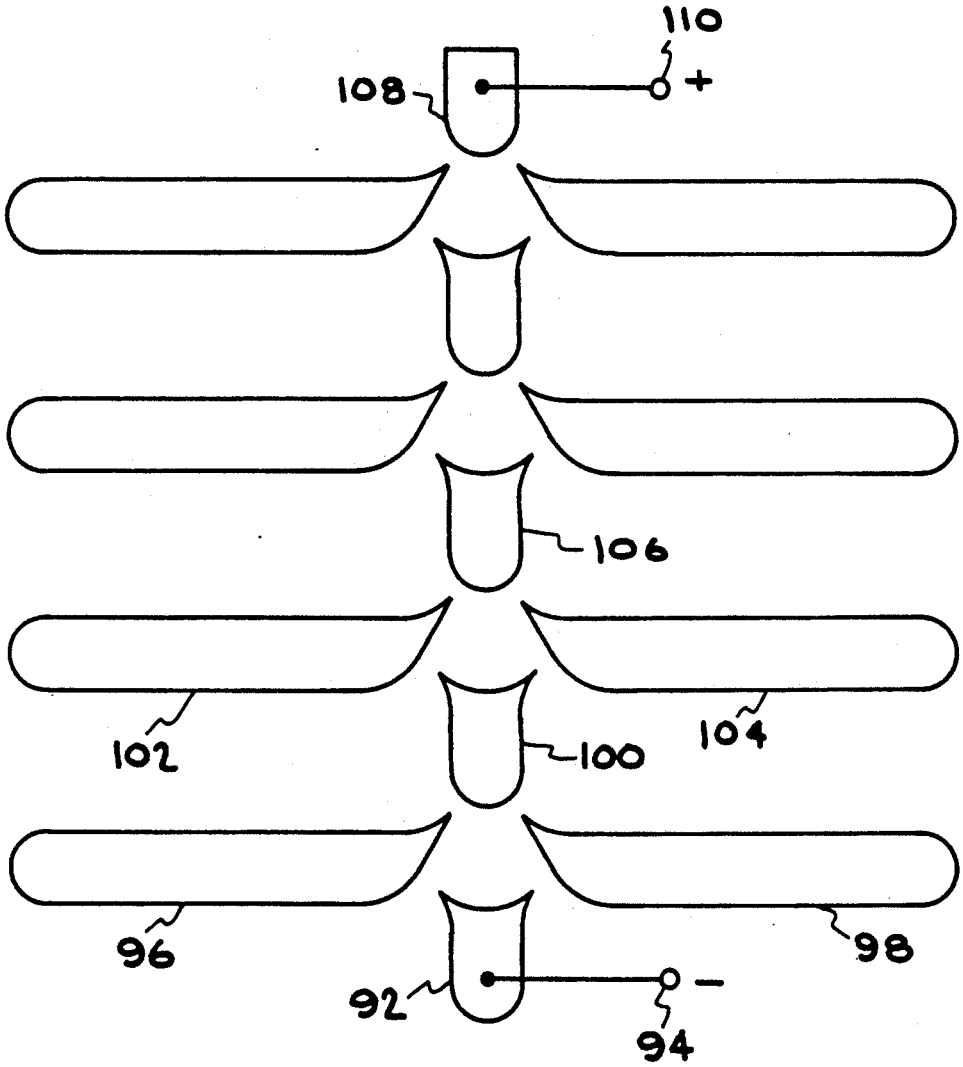
FIG. 7 is a top view of an array of full wave rectennas in series.

An advantage of the invention is that a large number of rectennas could be inexpensively combined in an array using conventional semiconductor manufacturing techniques. FIGS. 6 and 7 illustrate different arrays of rectennas. FIG. 6 shows a parallel array of the half wave rectennas shown in FIG. 1. For clearer illustration of the embodiment, only the pattern of conductive strips is shown. Each half wave rectenna in the array has a first half 80 and a second half 82 of an antenna. Each first half 80 of an antenna has an integrally connected cathode tip 84. Each second half 82 of an antenna has an integrally connected anode surface 86. Each first half 80 of an antenna is electrically connected to a first load terminal 85 and a first half of a capacitor 87. Each second half 82 of an antenna is electrically connected to a second load terminal 86 and a second half of the capacitor 87. Each individual rectenna would function like the rectenna embodiment illustrated in FIG. 1. Attaching them in a parallel configuration as illustrated would increase the current available at the terminals.

FIG. 7 shows a series array of the full wave rectennas shown in FIG. 5. For clear illustration only the pattern of conductive strips is shown. The array comprises a first terminal 92 electrically connected to a first load terminal 94. The electromagnetic signal to be rectified will cause electrons to flow from the first terminal 92 to the first half 96 of a first antenna and the second half 98 of the first antenna. The electromagnetic signal will also cause electrons to flow from the first half 96 of the first antenna and the second half 98 of the first antenna to a second terminal 100. The second terminal 100 acts as an anode terminal to the first antenna. The electromagnetic signal will cause electrons to flow from the second terminal 100 to the first half 102 of a second antenna and the second half 104 of the second antenna. The electromagnetic signal will also cause electrons to flow from the first half 102 of the second antenna and the second half 104 of the second antenna to a third terminal 106. The second terminal 100 acts as a cathode terminal to the second antenna, and the third terminal 106 acts as an anode terminal to the second antenna. The electrons continue to flow through the subsequent antenna elements and terminals until they reach a final terminal 108, which is electrically connected to a second load terminal 110. This series configuration will increase the voltage across the first 94 and second 110 load terminals.

In either the parallel or the series configurations, an external capacitor could be connected to the load terminals.

Figure 8:
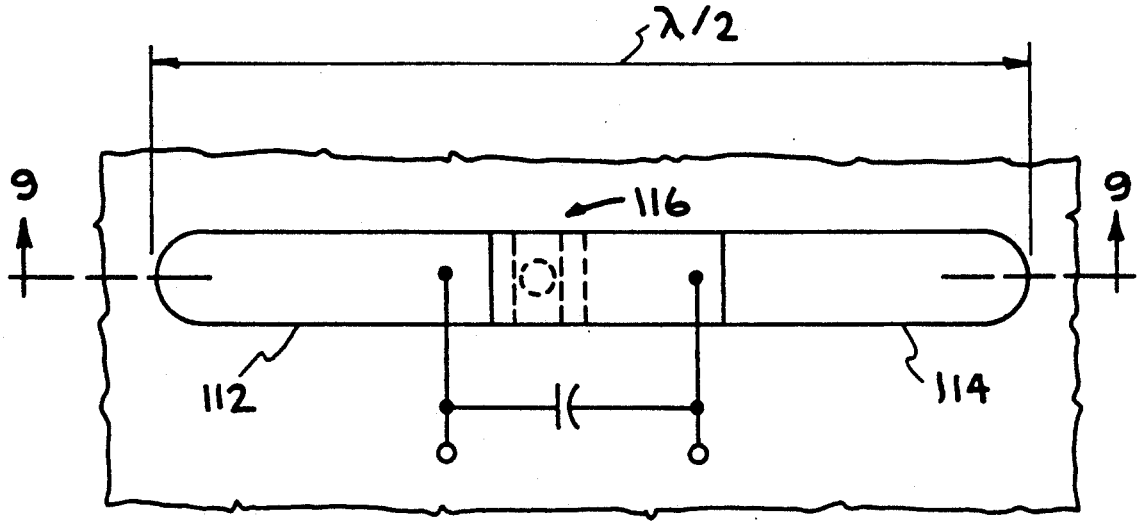
FIG. 8 is a top view of another embodiment, a half wave rectenna using a dipole antenna and a single vertical field emission diode rectifier.
Figure 9:
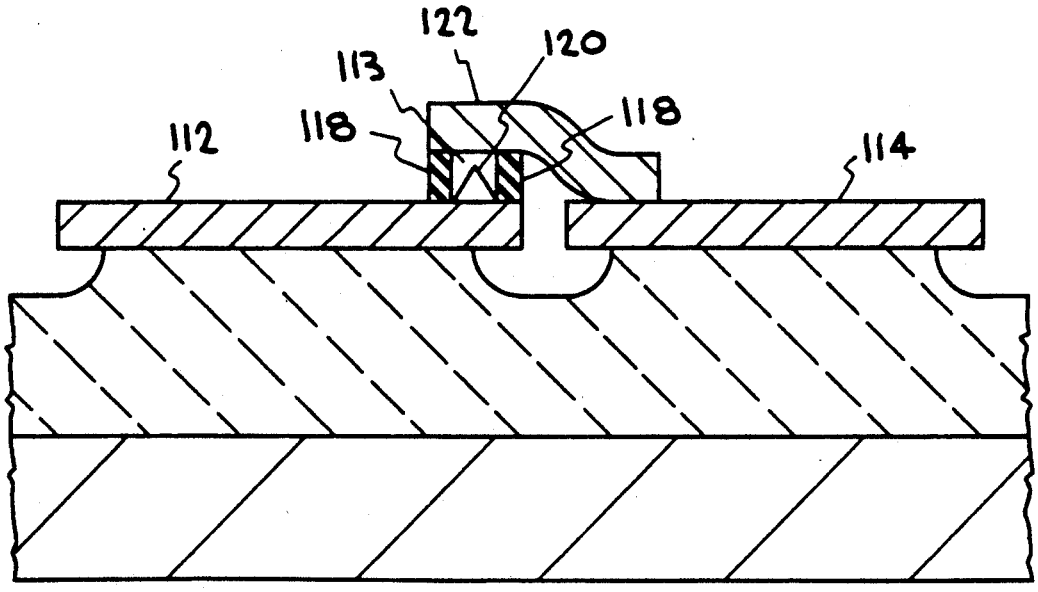
FIG. 9 is a cross-sectional view of a half wave rectenna illustrated in FIG. 8 along lines 9.

In addition to the lateral diode shown so far, a vertical field emission diode can also be used as the rectifier in a rectenna. FIGS. 8 and 9 show a half wave rectenna using a half wave vertical field emission diode 116 and a dipole antenna with a first half 112 and a second half 114. The vertical field emission diode comprises an insulator 118 placed on the first half 112 of the antenna. In a hole 113, formed in the insulator, a conductive cone or pyramid 120 is formed in electrical contact with the first 112 half of the antenna. A conducting cap 122 is placed over the hole 113, that also makes electrical contact with the second half 114 of the antenna. The hole 113 can be evacuated and sealed, forming an integral vacuum diode. In operation this embodiment works in the same manner as the embodiment illustrated in FIGS. 1 and 2, except that the vertical diode causes the electrons to be emitted vertically off of the tip of the cone or pyramid 120 instead of horizontally off of the point. The manufacturing of vertical field emission diodes is described in U.S. Pat. No. 4,721,885 by Brodie, and U.S. Pat. Nos. 3,755,704 and 3,789,471 by Spindt incorporated by reference.

The foregoing description of preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. A rectifying antenna for rectifying electromagnetic radiation with a wavelength shorter than 3.0 centimeters, comprising:

an antenna having a first half and a second half; and a first field emission diode for rectifying a current flow, wherein the first field emission diode has a first anode and first cathode electrically connected between the first half of the antenna and the second half of the antenna, and wherein the first cathode is separated from the first anode by a distance of less than 10 microns and wherein the antenna has a length which is approximately equal to half of the wavelength of the electromagnetic radiation to be rectified.

2. A rectifying antenna as claimed in claim 1, further comprising:

a first load terminal electrically connected to the first half of the antenna; and a second load terminal electrically connected to the second half of the antenna, and wherein the first cathode is electrically connected to the first half of the antenna, and the first anode is electrically connected to the second half of the antenna.

3. A rectifying antenna as claimed in claim 2, wherein the first cathode is integral with the first part of the first antenna, and wherein said first cathode comprises a pointed edge of the first part of the antenna, and wherein the first anode is integral with the second part of the antenna, and wherein the first anode comprises a nonpointed edge of the second part of the antenna.

4. A rectifying antenna as claimed in claim 2, wherein the first field emission diode is a linear field emission diode.

5. A rectifying antenna as claimed in claim 2, wherein the first field emission diode is a vertical field emission diode.

6. A rectifying antenna as claimed in claim 1, further comprising:

a first terminal, wherein the first field emission diode is electrically connected between the first terminal and the second half of the antenna with the first anode being electrically connected to the first terminal and the first cathode being electrically connected to the second half of the antenna;

a second terminal;

a second field emission diode with a second cathode and second anode electrically connected between the first terminal and the first half of the antenna with the second anode being electrically connected to the first terminal and the second cathode being electrically connected to the first half of the antenna;

a third field emission diode with a third cathode and a third anode electrically connected between the second terminal and the first half of the antenna with the third anode being electrically connected to the first half of the antenna and the third cathode being electrically connected to the second terminal; and a fourth field emission diode with a fourth cathode and a fourth anode electrically connected between the second terminal and the second half of the antenna with the fourth anode being electrically connected to the second half of the antenna and the fourth cathode being electrically connected to the second terminal.

7. A rectifying antenna as claimed in claim 6, wherein the first cathode is formed by a pointed edge of the second half of the antenna, and wherein the second cathode is formed by a pointed edge of the first half of the antenna, and wherein the first and second anodes are formed by nonpointed edges of the first terminal, and wherein the third anode is formed by a nonpointed edge of the first half of the antenna, and wherein the fourth anode is formed by a nonpointed edge of the second half of the antenna, and wherein the third and fourth cathodes are formed by pointed edges of the second terminal.

8. A rectifying antenna as claimed in claim 6, wherein the field emission diode is a lateral field emission diode.

9. A rectifying antenna for rectifying electromagnetic radiation with a wavelength shorter than 3.0 centimeters, comprising:

a substrate comprising a layer of insulating material;

a first cathode;

a first anode;

a first conductive strip on the substrate, with a length in a first direction, wherein the first conductive strip is integrally and electrically connected to the first cathode;

a second conductive strip on the substrate, with a length in the first direction, wherein the second conductive strip is integrally and electrically connected to the first anode, and wherein the second conductive strip is located along the first direction with respect to the first conductive strip, and wherein the length of the first conductive strip in the first direction is less than half of the wavelength and wherein the length of the second conductive strip in the first direction is less than half of the wavelength, and wherein the length of the first conductive strip in the first direction summed with the length of the second conductive strip in the first direction make a sum which is approximately equal to half of the wavelength;

a first load terminal electrically connected to the first conducting strip; and a second load terminal electrically connected to the second conducting strip, wherein the first cathode is located on the part of the first conductive strip closest to the second conductive strip, and wherein the first anode is located on the part of the second conductive strip closest to the first cathode, and wherein the first anode and the first cathode are separated by a distance less than 10 microns forming a first field emission diode.

10. A rectifying antenna as claimed in claim 9, wherein the cathode is formed by a pointed edge of the first conductive strip, and wherein the anode is formed by a nonpointed edge of the second conductive strip.

11. A rectifying antenna as claimed in claim 9, wherein the first field emission diode is a vertical field emission diode.

12. A rectifying antenna for rectifying electromagnetic radiation with a wavelength shorter than 3.0 centimeters, comprising:

a substrate comprising a layer of insulating material with a first surface;

a first conductive strip on a first surface of the substrate with a length in a first direction wherein a pointed edge of the first conductive strip forms a cathode of a linear field emission diode; and a second conductive strip on the first surface of the substrate with a length in the first direction wherein the second conductive strip forms an anode of a linear field emission diode, and wherein the second conductive strip is located along the first direction with respect to the first conductive strip, and wherein the length of the first conductive strip in the first direction is less than half the wavelength, and wherein the length of the second conductive strip in the first direction is less than half the wavelength and wherein the length of the first conductive strip in the first direction summed with the length of the second conductive strip in the first direction make a total length which is approximately equal to half of the wavelength.

13. A rectifying antenna as claimed in claim 12, further comprising a conductive layer on a second surface of the substrate, wherein the conductive layer is separated from the first conductive strip by a distance which is approximately equal to one fourth of the wavelength.

14. A rectifying antenna as claimed in claim 13, further comprising:

a first load terminal electrically connected to the first conductive strip; and a second load terminal electrically connected to the second conducting strip, wherein the cathode is located on the part of the first conductive strip closest to the second conductive strip, and wherein the anode is located on the part of the second conductive strip closest to the cathode, and wherein the first anode and the first cathode are separated by a distance less than 10 microns forming a field emission diode.

15. A rectifying antenna as claimed in claim 13, further comprising:

a third conductive strip on the first surface of the substrate with first and second nonpointed edges that form first and second anodes, wherein a pointed edge of the second conductive strip forms a cathode, and the first anode of the third conductive strip is located less than 10 microns away from the cathode on the first conductive strip forming a first field emission diode and the second anode of the third conductive strip is located less than 10 microns away from the cathode on the second conductive strip forming a second field emission diode; and a fourth conductive strip on the first surface of the substrate with first and second pointed edges that form first and second cathodes, wherein a non-pointed edge of the first conductive strip forms an anode, and the first cathode of the fourth conductive strip is located less than 10 microns away from the anode on the first conductive strip forming a third field emission diode and the second cathode of the fourth conductive strip is located less than 10 microns away from the anode on the second conductive strip forming a fourth field emission diode.

* * * * *